US005485951A

United States Patent [19]

Phillips

[11] Patent Number: 5,485,951

[45] Date of Patent: Jan. 23, 1996

[54] COLLAPSIBLE CONTAINER

[75] Inventor: Ronald W. Phillips, Durand, Ill.

[73] Assignee: Longview Fibre Company, Longview, Wash.

[21] Appl. No.: 416,197

[22] Filed: Apr. 4, 1995

[51] Int. Cl.[6] ..... B65D 5/10

[52] U.S. Cl. ..... 229/156; 229/109; 229/185

[58] Field of Search ..... 229/109, 155, 229/156, 185

[56] References Cited

U.S. PATENT DOCUMENTS

| | | | |
|---|---|---|---|
| 281,354 | 7/1883 | Edwards | 229/185 |
| 2,269,013 | 1/1942 | Dorfman | 229/185 |
| 4,343,429 | 8/1982 | Cherry | 229/109 |
| 4,386,729 | 6/1983 | Schmidt | 229/109 |
| 4,441,649 | 4/1984 | Nederveld | 229/185 |
| 4,702,408 | 10/1987 | Powlenko | 229/109 |
| 4,756,409 | 7/1988 | Murray | 229/185 |
| 4,899,927 | 2/1990 | Straub et al. | 229/185 |
| 4,948,035 | 8/1990 | Wischoff | 229/156 |
| 4,953,782 | 9/1990 | Noland | 229/156 |

*Primary Examiner*—Gary E. Elkins
*Attorney, Agent, or Firm*—Chernoff, Vilhauer, et al.

[57] ABSTRACT

A collapsible container is formed from a blank of foldable sheet material. The container includes a plurality of upright first wall panels, second wall panels, and corner panels foldably connected to and disposed between a first wall panel and a second wall panel. The first wall panels, second wall panels and corner panels act together to define a predetermined area. Bottom forming side flaps are foldably connected to the bottom edges of the first wall panels and extend therefrom towards one another into the predetermined area, wherein the side flaps extend laterally beyond the first wall panels. Bottom forming end flaps are foldably connected to the bottom edges of the second wall panels and extend therefrom towards one another into the predetermined area. Portions of the end flaps overlie portions of the side flaps when both the end flaps and the side flaps are respectively extending towards the predetermined area. Each end flap is divided into an inner and outer portion by a fold line with notches being aligned and oppositely disposed on either side of the end flaps with said fold line and being configured to allow a portion of the end flap defined by the fold line to fit between the side flap. The outer portion of each end flap forms a locking element that fits between the side flaps when the outer portion is bent along the fold line relative to the inner portion and the side flaps are inserted into the notches.

1 Claim, 3 Drawing Sheets

COLLAPSIBLE CONTAINER

BACKGROUND OF THE INVENTION

The present invention relates to a collapsible storage container for the transportation and storage of products.

Numerous types of products are handled in bulk when transported to storage facilities, retailers, and consumers. One example of such a product is fresh produce (apples, oranges, mangos, watermelon, etc.). A relatively large storage container is desirable for efficient transportation of such products. Such a container must be designed to withstand a substantial weight of products loaded within the container for transportation and storage. Further, the container should be simple to use, capable of being reused, easily loaded and unloaded, collapsible to minimize storage space when not in use, and inexpensive.

A container of this type is disclosed in Nederveld, U.S. Pat. No. 4,441,649. While generally suitable for the intended use, the container in Nederveld has shortcomings. The Nederveld container is locked in its erected configuration by inserting portions of the end bottom flaps over and then under portions of the side bottom flaps which may cause tearing or deformation of the engaging slots. Due to the stiffness of the corrugated fiberboard used for these containers, assembling often requires bending of the elements which can weaken them. In addition, this overlapping flap arrangement does not retain the container well enough in its erected configuration.

SUMMARY OF THE PRESENT INVENTION

The present invention overcomes the aforementioned drawbacks of the prior art by providing a collapsible container formed from a blank of foldable sheet material. The container includes a plurality of upright first wall panels, second wall panels, and corner panels that are foldably connected to and disposed between respective first wall panels and second wall panels. The first wall panels, second wall panels, and corner panels all act together to define a predetermined area for the storage of products therein. Bottom forming side flaps are foldably connected to the bottom edges of the first wall panels and extend therefrom towards one another into the predetermined area. The side flaps extend laterally beyond the first wall panels. Bottom forming end flaps are foldably connected to the bottom edges of the second wall panels and extend therefrom towards one another into the predetermined area. Portions of the end flaps overlie portions of the side flaps when both the end flaps and the side flaps, respectively, extend towards the predetermined area. Each end flap is divided into an inner portion and outer portion by a fold line between notches aligned on oppositely disposed sides of the end flaps. The end flaps are configured to allow a portion of each end flap, defined by the respective fold line, to fit between the side flaps. The outer portion of each end flap forms a locking element that fits between the side flaps when both the outer portion is bent along the fold line relative to the inner portion and the side flaps are inserted into the notches.

The foregoing and other objectives, features, and advantages of the invention will be more readily understood upon consideration of the following detailed description of the invention, taken in conjunction with the accompanying drawings.

DESCRIPTION OF THE PREFERRED EMBODIMENT

Figure 1:
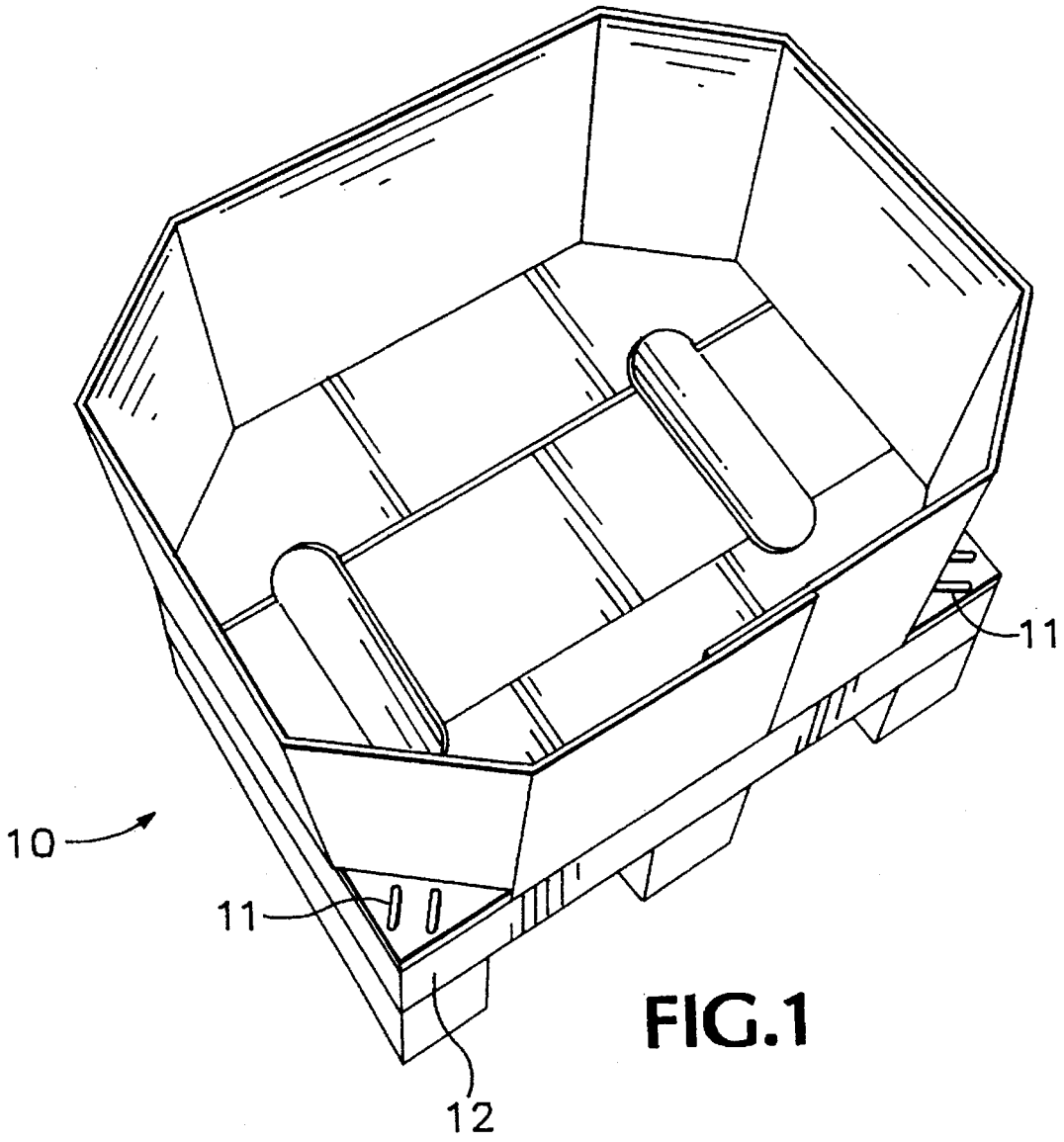
FIG. 1 is a perspective top view of the preferred embodiment of the collapsible container shown secured to a conventional pallet.

A collapsible container 10 as shown in FIG. 1 is particularly suitable for storing bulk articles, such as fresh produce. The container 10 is attached by suitable fasteners, such as staples 11, to a conventional wooden pallet 12. The staples 11 are preferably affixed through extension portions 38*a*, 38*b*, 38*c*, 38*d* that extend outward from the corners of the container 10 providing a simple way of securing the container 10 to the pallet 12 from a location on the exterior of the container 10. With a loaded container 10 suitably affixed to the pallet 12, it may be readily handled by a forklift truck in a conventional manner.

Figure 2:
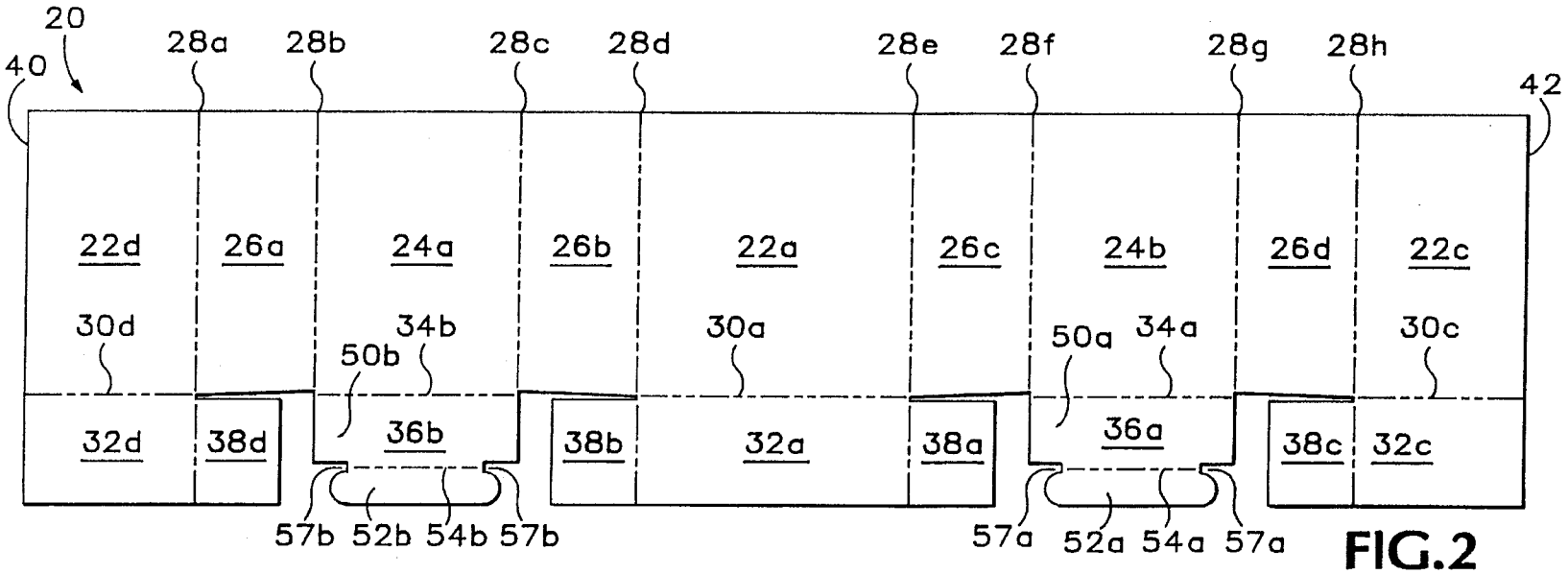
FIG. 2 is a fragmentary plan view of a blank employed to assemble the container shown in FIG. 1.

Referring to FIG. 2, the container 10 is formed from an inexpensive blank 20 of foldable sheet material, such as triple-wall corrugated fiberboard. The blank 20 includes first wall panels 22*a*, 22*c* and 22*d*, where first wall panels 22*c* and 22*d* are overlapped and affixed together during assembly of the container 10 to form a single first wall panel 22*b* that has the same width as first wall panel 22*a*. The blank 20 also includes a pair of second wall panels 24*a* and 24*b*, and four corner panels 26*a*, 26*b*, 26*c*, and 26*d*. Adjacent first wall panels 22*a*, 22*c*, 22*d*, second wall panels 24*a*, 24*b*, and corner panels 26*a*–26*d* are connected to one another by a plurality of elongated fold lines 28*a*–28*h* arranged in a spaced-apart parallel relation to each other. It is to be readily understood, that a container with a different shape, size, and number of sides, can be constructed by modifying the wall and corner panels.

Foldably connected to the first wall panels 22*a*, 22*c* and 22*d* by fold lines 30*a*, 30*c*, and 30*d* are respective side flaps 32*a*, 32*c*, and 32*d*. By overlapping and affixing together side flaps 32*c* and 32*d* during assembly of the container 10 a single side flap 32*b* is formed that has the same length as side flap 32*a*. Foldably connected to the second wall panels 24 and 24*b* by fold lines 34*a* and 34*b* are respective bottom forming end flaps 36*a* and 36*b*. End flaps 36*a* and 36*b* are similar if not identical to each other, as are side flaps 32*a* and 32*b*. The side flaps 32*a* and 32*b* define respective extension portions 38*a*–38*b* and 38*c*–38*d*, disposed at opposite ends. The extension portions 38*a*–38*d* adjoin the corner panels 26*a*–26*d*, respectively. While the side flaps 32*a* and 32*b* are foldably connected to respective first wall panels 26*a*–26*d*, the extension portions 38*a*–38*d* are not foldably connected to adjacent corner panels 26*a*–26*d*, to allow assembly of the container 10.

Each end flap 36*a*, 36*b* defines both an inner portion 50*a*, 50*b* and an outer portion 52*a*, 52*b*. A pair of oppositely opposed notches 57*a* and 57*b* are defined between the respective inner and outer portions. The inner portions 50*a*, 50*b* and outer portions 52*a*, 52*b* are divided by respective fold lines 54*a*, 54*b* that extend between the notches 57*a* and 57*b*. As will be more fully explained later, each outer portion 52*a*, 52*b* is configured to be foldable between the side flaps 32*a* and 32*b*, when the container 10 is assembled, so as to be able to fit behind the side flaps 32*a*, 32*b*.

Figure 3:
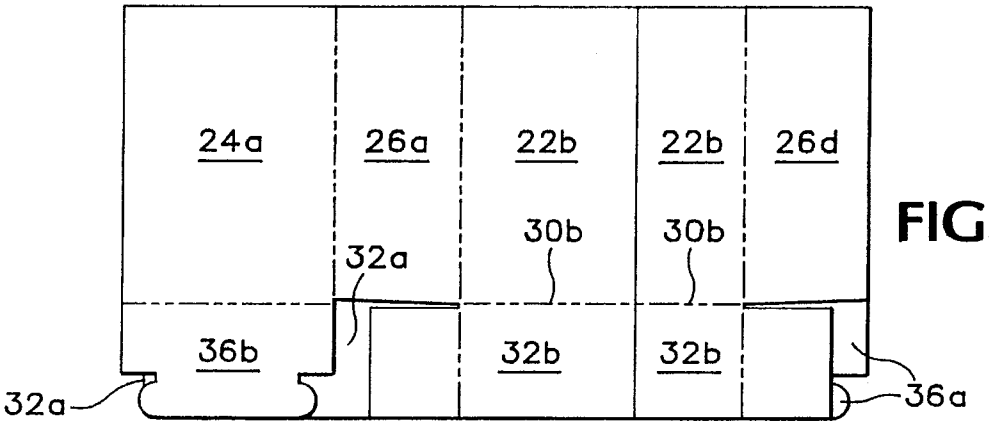
FIG. 3 is a side elevational view of the container shown in FIG. 1 in a collapsed state and disassembled from the pallet.

Referring to FIG. 3, to prepare the blank 20 for erection of the container 10, the blank 20 may be folded along fold lines 28*c* and 28*g* to allow respective edges 40 and 42 to be folded into a location proximate each other. Thereafter, the first wall panel 22*c* is folded in an overlapping relationship with first wall panel 22*d* and they are both affixed together by any suitable adhesive or fastener to form first wall panel 22*b*. First wall panel 22*c* may overlie first wall panel 22*d*, or vice versa. With blank 20 in a folded or collapsed state, as shown in FIG. 3, it may be compactly stored for future use or returned to the sender for reuse.

After the blank 20 is in the collapsed state, as shown in FIG. 3, it may be squared up and inverted so that both the bottom forming side flaps 32*a* and 32*b*, and the bottom forming end flaps 36*a* and 36*b* all extend upwardly. While in the squared-up position, the first wall panels 22*a* and 22*b*, the second wall panels 24*a* and 24, and the corner panels 26*a*–26*d*, all act together to delineate a predetermined area enclosed within a general octagonal area. In the preferred embodiment, the first wall panels 22*a* and 22*b* are in an opposed substantially parallel relation to each other, and the second wall panels 24*a* and 24*b* are also in an opposed substantially parallel relation to each other. The corner panels 26*a*–26*d* are obliquely opposed relative to adjacent first wall panels 24*a* and 24*b*, and second wall panels 24*a* and 24*b*, to which they are connected.

Figure 5:
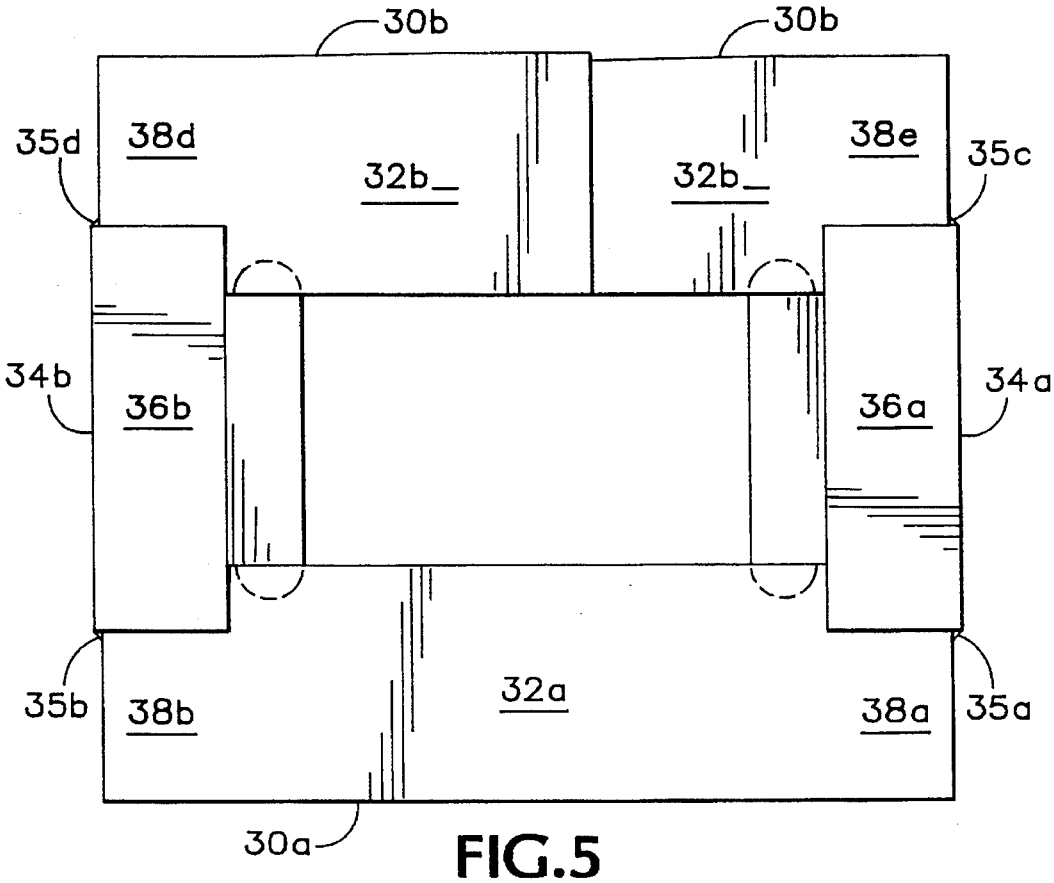
FIG. 5 is a bottom plan view of the container shown in FIG. 1 and dissembled from the pallet.

Referring to FIG. 5, side flaps 32*a* and 32*b* are then folded at an angle of approximately 90 degrees toward one another into the predetermined area. The end flaps 36*a* and 36*b* are likewise folded at an angle of approximately 90 degrees towards one another into the predetermined area overlying the side flaps 32*a* and 32*b*. The fold lines 30*a*, 30*c*, 30*d*, 34*a* and 34*b* form a portion of the lower or bottom edges of the container 10 when it is set up for loading, as shown in FIG. 1. A portion of the end edges of the extension portions 38*a*, 38*b*, 38*c*, 38*d* are sized to respectively engage a portion of the fold line 34*a* or 34*b* in areas generally designated as 35*a*, 35*b*, 35*c*, and 35*d* which increases the stability and integrity of the assembled container 10.

Each of the outer portions 52*a*, 52*b* is then bent inward along its fold line 54*a*, 54*b* relative to the respective inner portion 50*a*, 50*b*, and the edges of the side flaps 32*a* and 32*b* are inserted into the notches 57*a* and 57*b*. Because of the resilient character of fiber-board material and the configuration of the various flaps, the container 10 will distort the required amount to permit the outer portions 52*a* and 52*b* of the end flaps 36*a* and 36*b* to assume the locked position. Once the outer portions 52*a* and 52*b* are in the locked position, the container 10, including the side flaps 32*a* and 32*b*, will quickly return to its normal undistorted shape and thus result in an effective interlocking of all the bottom forming flaps. When the container 10 is loaded, the weight of the accumulated articles exerts a force on the bottom forming flaps to help retain them in their proper position.

Figure 4:
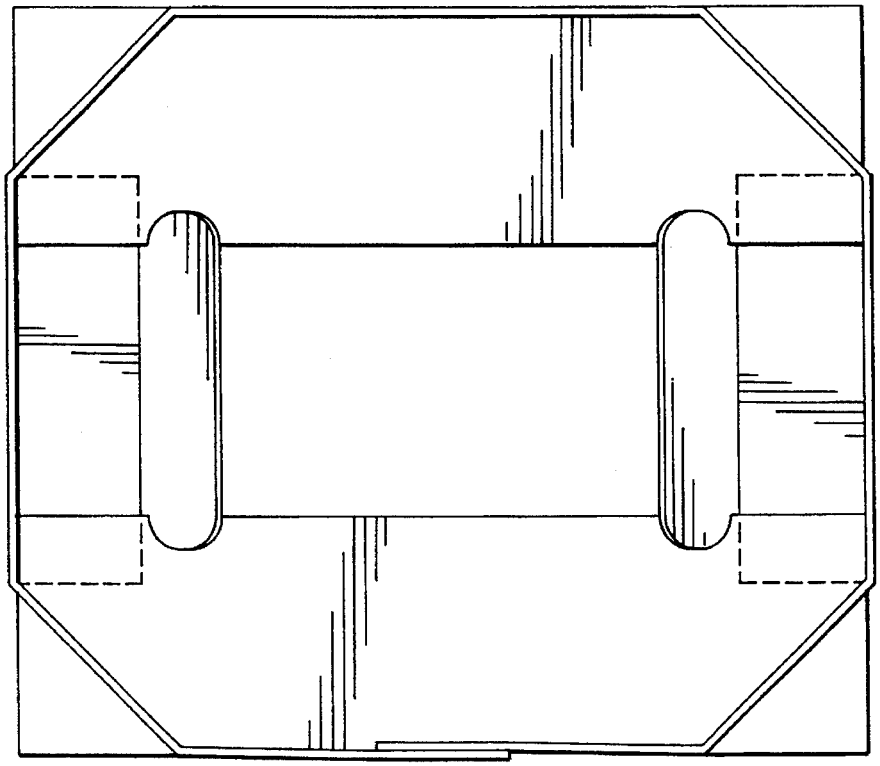
FIG. 4 is a top plan view of the container shown in FIG. 1 and dissembled from the pallet.

Once the blank 20 has assumed the setup or assembled state, as shown in FIG. 5, it is manually turned over as illustrated in FIG. 4. The outer portions 52*a* and 52*b* of the end flaps 36*a* and 36*b* extend upwardly at an angle extending into the container 10. When the container 10 is not used in combination with a pallet 12, it may rest directly on any suitable supporting surface or the ground. The extension portions 38*a*–38*d* extend laterally beyond the first wall panels 22*a* and 22*b* in an area adjacent to the corner panels 26*a*–26*d* to allow a suitable place to affix the container 10 to the pallet 12. The extension portions 38*a*–38*d* also provide the container 12 with increased stability. The fold lines 28*a*–28*h* are preferably aligned perpendicular to fold lines 30*a*, 30*c*, 30*d*, 34*a*, and 34*b* so that the erected container 10 has perpendicular upright sides with respect to its bottom and the pallet 12.

The container 10 as described includes four bottom forming flaps 32*a*, 32*b*, 36*a*, and 36*b*. However, the outer portions 52*a* and 52*b* could alternatively be affixed to the side flaps 32*a* and 32*b* and thereby lock under the end flaps 36*a* and 36*b*. Additionally, the dimensions of the bottom forming flaps 32*a*, 32*b*, 36*a*, and 36*b* may be modified so that the elongate free edges of the bottom forming flaps nearly abut one another thus effectively eliminating the open gap through the bottom of the container 10. Also, an inexpensive pad may be placed over the open gap in the bottom of the container 10 to reduce the amount of cardboard used in the container 10. In certain circumstances it may be desirable to close the top of the container 10. Closing the top can be accomplished by a conventional telescoping cover or by a closure foldably connected to the upper edges of the side, end, and corner flaps.

The footprint of the container may be conformed substantially to the entire surface, or just a portion, of the pallet 12. In the latter case, a plurality of containers could be supported on a single pallet 12. The shape, size and location of the slots may be varied, as desired, to facilitate manual interlocking of the bottom forming flaps. When the container is affixed to the pallet 12, it is not essential that the flaps be placed in an interlocking relationship, but merely that the flaps overlap on one another.

Overall, the resulting container 10 is strong, versatile, inexpensive and is capable of accommodating a wide variety of articles therein. The improved container 10 is capable of assuming a collapsed state, as shown in FIG. 3, for compact storage or reuse. The container 10 may be set up manually by a single individual without the need for special tools or fixtures.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A collapsible container formed from a blank of foldable sheet material, comprising:

(a) a plurality of upright first wall panels;

(b) a plurality of upright second wall panels;

(c) a plurality of upright corner panels;

(d) each said corner panel foldably connected to and disposed between a first wall panel and a second wall panel;

(e) said first wall panels, said second wall panels, and said corner panels acting together to define a predetermined area;

(f) bottom forming side flaps foldably connected to bottom edges of said first wall panels and extending therefrom towards one another into said predetermined area, said side flaps extending laterally beyond said first wall panels;

(g) bottom forming end flaps foldably connected to bottom edges of said second wall panels, and extending therefrom towards one another into said predetermined area, portions of said end flaps overlying portions of said side flaps when both said end flaps and said side flaps are respectively extending towards said predetermined area;

(h) each said end flap being divided into an inner and outer portion by a fold line;

(i) a pair of oppositely disposed notches on either side of each of said end flaps, said notches being aligned with said fold line and being configured to allow the portion of said end flap defined by said fold line to fit between said side flaps; and (j) said outer portion of each said end flap forming a locking element that fits behind said side flaps when said outer portion is bent along said fold line relative to said inner portion and said side flaps are inserted into said notches.

* * * * *